US009746793B2

(12) United States Patent
Mitsunobu

(10) Patent No.: US 9,746,793 B2
(45) Date of Patent: Aug. 29, 2017

(54) IMAGE FORMATION APPARATUS AND IMAGE FORMING METHOD

(71) Applicant: Oki Data Corporation, Tokyo (JP)

(72) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/528,194

(22) Filed: Oct. 30, 2014

(65) Prior Publication Data

US 2015/0117886 A1 Apr. 30, 2015

(30) Foreign Application Priority Data

Oct. 31, 2013 (JP) ..... 2013-226962

(51) Int. Cl.
*G03G 15/02* (2006.01)

(52) U.S. Cl.
CPC ..... *G03G 15/0266* (2013.01)

(58) Field of Classification Search
CPC ..... G03G 15/02
USPC ..... 399/50
See application file for complete search history.

(56) References Cited

U.S. PATENT DOCUMENTS 5,636,009 A * 6/1997 Honda ..... G03G 15/0266 399/176
2004/0053153 A1* 3/2004 Yaguchi ..... G03G 9/0902 430/106.1
2008/0181652 A1* 7/2008 Sato ..... G03G 15/0808 399/83
2010/0329703 A1* 12/2010 Ozeki ..... G03G 15/0815 399/27
2013/0259502 A1* 10/2013 Motomura ..... G03G 15/1645 399/50
2014/0037313 A1* 2/2014 Kawano ..... G03G 15/0848 399/55

FOREIGN PATENT DOCUMENTS

| | | | |
|---|---|---|---|
| JP | 2005-077577 | A | 3/2005 |
| JP | 2008-164662 | A | 7/2008 |
| JP | 2009-175224 | A | 8/2009 |
| JP | 2010-169898 | A | 8/2010 |
| JP | 2010-204322 | A | 9/2010 |
| JP | 2011-107578 | A | 6/2011 |
| JP | 2011-128345 | A | 6/2011 |

* cited by examiner

*Primary Examiner* — Clayton E Laballe
*Assistant Examiner* — Fang-Chi Chang
(74) *Attorney, Agent, or Firm* — Mots Law, PLLC

(57) ABSTRACT

An image formation apparatus includes: a first image formation unit including a first image carrier and a first charging member that charges the first image carrier, the first image formation unit using a first developer and; a second image formation unit including a second image carrier and a second charging member that charges the second image carrier, the second image formation unit using a second developer; and a controller that determines a first charging voltage correction amount for correcting a charging voltage to be applied to the first charging member according to an amount of usage of the first image carrier, and determines a second charging voltage correction amount for correcting a charging voltage to be applied to the second charging member according to an amount of usage of the second image carrier. The second charging voltage correction amount is larger than the first charging voltage correction amount.

8 Claims, 10 Drawing Sheets

IMAGE FORMATION APPARATUS AND IMAGE FORMING METHOD

CROSS REFERENCE TO RELATED APPLICATIONS

This application claims priority based on 35 USC 119 from prior Japanese Patent Application No. 2013-226962 filed on Oct. 31, 2013, entitled "IMAGE FORMATION APPARATUS AND IMAGE FORMING METHOD", the entire contents of which are incorporated herein by reference.

BACKGROUND OF THE INVENTION

1. Field of the Invention

This disclosure relates to an image formation apparatus and an image forming method.

2. Description of Related Art

An image formation apparatus of an electrophotographic recording type which fixes toner on a recording medium to form an image has heretofore been known. For example, a conventional image formation apparatus performs good printing by determining the amount of film scraping according to a drive status of a photoreceptor drum, and by correcting an image formation condition for the amount of film scraping. (Refer to Japanese Patent Application Publication No. 2011-107578 (Patent Literature 1), for example.)

SUMMARY OF THE INVENTION

However, use of a predetermined developer may cause an improper correction of the image formation condition because of properties of the developer, and hence the conventional image formation apparatus may have difficulty in achieving a good image quality.

Therefore, an object of an embodiment of the invention is to achieve a good image quality.

A first aspect of the invention is an image formation apparatus that includes: a first image formation unit including a first image carrier and a first charging member configured to charge the first image carrier, the first image formation unit configured to use a first developer; and a second image formation unit including a second image carrier and a second charging member configured to charge the second image carrier, the second image formation unit configured to use a second developer; and a controller configured to determine a first amount of charging voltage correction for correcting a charging voltage to be applied to the first charging member according to an amount of usage of the first image carrier, and to determine a second amount of charging voltage correction for correcting a charging voltage to be applied to the second charging member according to an amount of usage of the second image carrier. The second amount of charging voltage correction is larger than the first amount of charging voltage correction.

A second aspect of the invention is an image formation apparatus that comprises: an image carrier; a charging unit configured to charge the image carrier by receiving an application of a charging voltage; an exposure unit configured to form an electrostatic latent image on the image carrier charged by the charging unit; a feed unit configured to feed a developer to the image carrier having the electrostatic latent image formed thereon by the exposure unit; and a controller configured to determine that when a developer of a predetermined color is used as the developer fed from the feed unit, the remaining life of the image carrier becomes shorter than that when a developer of another color is used, and to set a smaller absolute value of the charging voltage to be applied to the charging unit as the remaining life of the image carrier becomes shorter.

A third aspect of the invention is an image forming method that comprises: charging a first image carrier configured to use a first developer; charging a second image carrier configured to use a second developer; and determining a first amount of charging voltage correction for correcting a charging voltage to be applied in the charging of the first image carrier according to the amount of usage of the first image carrier; and determining a second amount of charging voltage correction for correcting a charging voltage to be applied in the charging of the second image carrier according to the amount of usage of the second image carrier. The second amount of charging voltage correction is larger than the first amount of charging voltage correction.

According to the above aspects of the invention, a good image quality can be obtained.

DETAILED DESCRIPTION OF EMBODIMENTS

Figure 1:
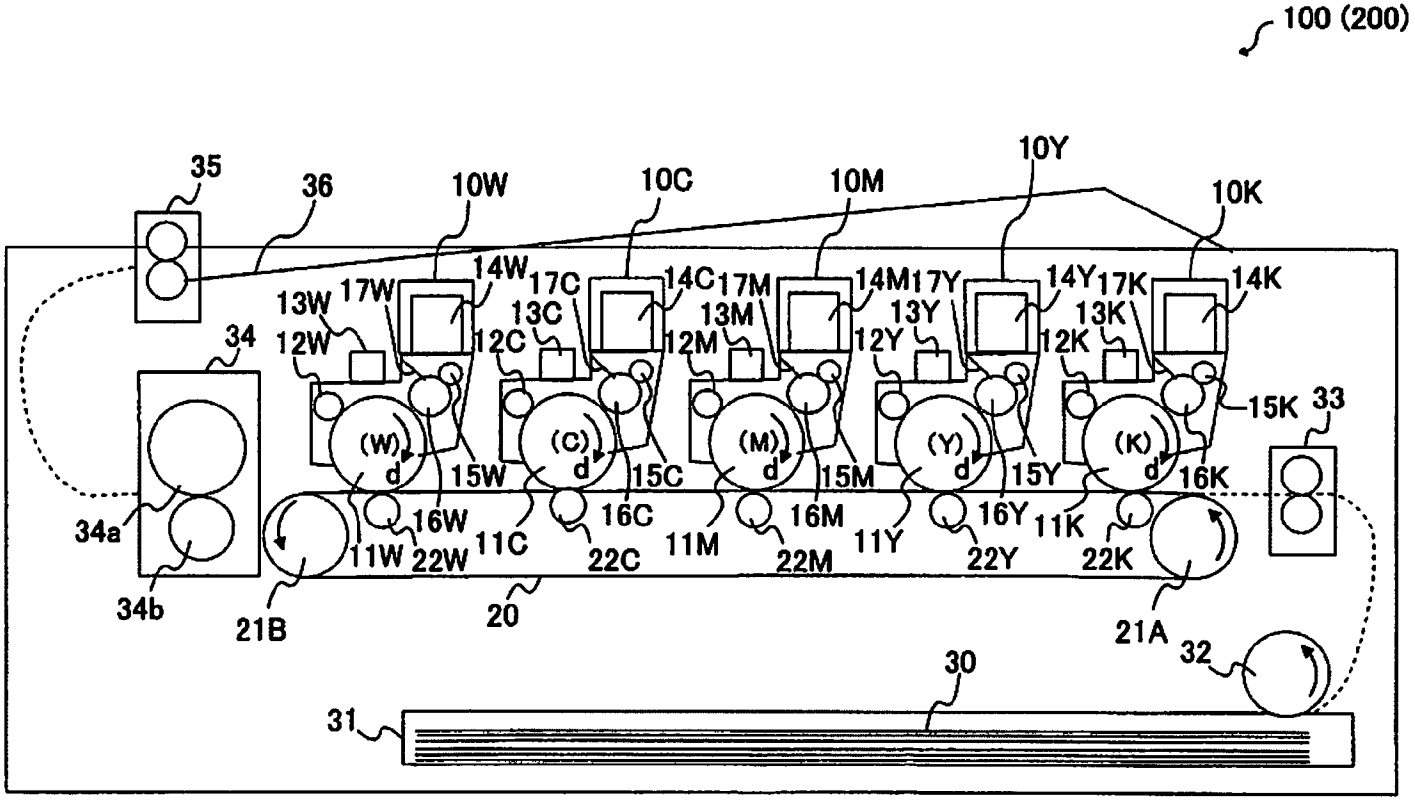
FIG. 1 is an overall configuration diagram illustrating in schematic form an overall configuration of an image formation apparatus according to Embodiments 1 and 2.

Descriptions are provided hereinbelow for embodiments based on the drawings. In the respective drawings referenced herein, the same constituents are designated by the same reference numerals and a duplicate explanation concerning the same constituents is omitted. All of the drawings are provided to illustrate the respective examples only.

Embodiment 1

A description is given below with reference to the drawings with regard to an image formation apparatus and an image forming method to which the invention is applied.

(Description of Configuration)

FIG. 1 is an overall configuration diagram illustrating in schematic form an overall configuration of image formation apparatus 100 according to Embodiment 1. The image forming method to which the invention is applied is implemented by image formation apparatus 100. In Embodiment 1, an electrophotographic printer capable of printing in five colors, i.e. black (K), yellow (Y), magenta (M), cyan (C), and white (W), is described by way of example. Incidentally, a parenthesized reference numeral in FIG. 1 indicates a configuration in Embodiment 2.

Image formation apparatus 100 includes five image formation units 10K, 10Y, 10M, 10C, 10W (hereinafter called image formation units 10 when there is no particular need to distinguish among the individual units). Five image formation units 10K, 10Y, 10M, 10C, 10W are arranged in this sequence along transfer belt 20 in a direction from the upstream side to the downstream side of a conveyance path of medium 30. Incidentally, transfer belt 20 is formed in an endless form and is configured to convey medium 30.

Image formation units 10K, 10Y, 10M, 10C, 10W include photoreceptor drums 11K, 11Y, 11M, 11C, 11W (hereinafter called photoreceptor drums 11 when there is no particular need to distinguish among the individual drums), charge rollers 12K, 12Y, 12M, 12C, 12W (hereinafter called charge rollers 12 when there is no particular need to distinguish among the individual rollers), LED (light emitting diode) heads 13K, 13Y, 13M, 13C, 13W (hereinafter called LED heads 13 when there is no particular need to distinguish among the individual heads), toner tanks 14K, 14Y, 14M, 14C, 14W (hereinafter called toner tanks 14 when there is no particular need to distinguish among the individual tanks), feed rollers 15K, 15Y, 15M, 15C, 15W (hereinafter called feed rollers 15 when there is no particular need to distinguish among the individual rollers), development rollers 16K, 16Y, 16M, 16C, 16W (hereinafter called development rollers 16 when there is no particular need to distinguish among the individual rollers), and layer formation blades 17K, 17Y, 17M, 17C, 17W (hereinafter called layer formation blades 17 when there is no particular need to distinguish among the individual blades), respectively.

Photoreceptor drums 11 are rotatably supported image carriers. Photoreceptor drums 11 each include a photosensitive layer portion having a photosensitive layer applied to an electrically conductive support worked in a cylindrical shape. The photosensitive layer portion has a multilayer structure including a blocking layer, a charge generation layer, and a charge transport layer, which are stacked in sequence one on top of another, as viewed from the surface of the electrically conductive support. In Embodiment 1, the charge transport layer is applied to about 18 μm. (Refer to Japanese Patent Application Publication No. 2009-288672, for example.) Here, a film of photoreceptor drum 11 refers to a predetermined film on the surface of photoreceptor drum 11. For example, in Embodiment 1, the film of photoreceptor drum 11 refers to the photosensitive layer portion. Incidentally, an eddy-current coating thickness tester LH-200 commercially available from Kett Electric Laboratory is used to measure the film thickness. Charge roller 12 is a charging unit configured to charge photoreceptor drum 11 through application of a charging voltage. For example, charge roller 12 is charged with a negative voltage, thereby to uniformly charge the surface of photoreceptor drum 11 contacting charge roller 12. LED head 13 is an exposure unit configured to form an electrostatic latent image on photoreceptor drum 11 charged by charge roller 12. For example, LED head 13 emits light based on print data (or image formation data) to expose negatively charged photoreceptor drum 11 to the light and discharge photoreceptor drum 11, thereby forming the electrostatic latent image on photoreceptor drum 11. Toner tank 14 accommodates the toner as a developer. Feed roller 15 is disposed so as to contact development roller 16, thereby to feed the toner to development roller 16. Feed roller 15 is constructed of a shaft made of metal and provided with a foam body molded on its outer periphery. For example, a silicone foam having a hardness of 50° (Askar F) is molded on the metal shaft. Development roller 16 is a feed unit configured to feed the developer to photoreceptor drum 11 having the electrostatic latent image formed thereon by LED head 13. For example, development roller 16 causes the toner to adhere to the electrostatic latent image thereby to develop an image. Development roller 16 is constructed of a shaft made of metal and provided with an elastic body molded on its outer periphery. For example, semiconductive urethane rubber having a rubber hardness of 70° (Asker C) is molded as the elastic body on the metal shaft. Layer formation blade 17 restricts the thickness of the toner fed onto development roller 16, thereby to form a thin layer on development roller 16.

Toner of each of the black, yellow, magenta, cyan and white colors is made of a polyester resin, a colorant, an electrification control agent, and a release agent, and contains an external additive (e.g. hydrophobic silica) added thereto. The toner of each color is obtained by a grinding process. For example, the black toner has an average particle diameter of 5.7 μm; the yellow toner, 5.6 μm; the magenta toner, 5.6 μm; the cyan toner, 5.6 μm; and the white toner, 7.0 μm. Incidentally, a known production process such as a polymerization process may be used to make the toner of each color. Also, the toner of each color has a circularity of 0.950 to 0.955, for example. The circularity of the toner is a value obtained by calculating, by Equation (1), the circularity of a particle measured by using a flow particle image analyzer (Model: FPIA-3000, commercially available from Sysmex Corporation), and dividing the sum total of the circularities of all measured particles by the total number of measured particles.

$$\text{Circularity} = \text{Circumferential length of a circle having the same projected area as that of the particle image} / \text{circumferential length of a projected image of a particle} \quad (1)$$

In Embodiment 1, the circularity is an index of the degree of unevenness of the toner particle. The circularity exhibits a value of 1.000 if the toner is perfectly spherical in shape, whereas the circularity has a smaller value as the toner becomes more complicated in shape.

Also, the amount of electrostatic charge on the toner of each color is as given below. The amount of electrostatic charge on the black toner is −55 μC/g, the amount of electrostatic charge on the yellow toner is −49 μC/g, the amount of electrostatic charge on the magenta toner is −44 μC/g, the amount of electrostatic charge on the cyan toner is −49 μC/g, and the amount of electrostatic charge on the white toner is −24 μC/g. The amount of electrostatic charge on the toner of each color is measured by a blow off measurement method. Specifically, the toner is frictionally electrified by stirring for 30 minutes a mixture specimen obtained by mixing 0.5 g of the toner with 9.5 g of a ferrite carrier (F-60), commercially available from Powdertech Co., Ltd. A shaker (Model: YS-LD, commercially available from YAYOI Co., Ltd.) is used to stir the mixture specimen. Shaking conditions are such that the number of shakings is 200 times per minute, a shaking angle lies between 0° and 45° inclusive, and a shaking amplitude is 80 mm. After that, the carrier is separated from the mixture specimen by performing a spraying at a withstand voltage blow pressure of 7.0 kPa and a suction at a suction pressure of −4.5 kPa for 10 seconds. Then, the amount of electric charge Q/M (unit: μC/g) of the toner particle per unit weight is calculated from the amount of electric charge and the amount of suction in the carrier after 10 seconds. Here, a powder charge measuring equipment (TYPE: TB-203, commercially available from KYOCERA Corporation) is used to measure the amount of electrostatic charge.

Organic pigments, for example, carbon black, pigment yellow, pigment magenta, and pigment cyan, and the like, are used as the colorants for black, yellow, magenta, and cyan, respectively. The colorants are made by being mixed together, and thus, somewhat transparent pigments are used as the colorants. A metallic pigment as a metal-base colorant, for example, titanium dioxide, is used as the colorant for white. The colorant for white is an opaque colorant.

Further, image formation apparatus 100 includes paper cassette 31, paper feed roller 32, conveyance roller unit 33, drive rollers 21A, 21B, transfer rollers 22K, 22Y, 22M, 22C, 22W (hereinafter called transfer rollers 22 when there is no particular need to distinguish among the individual rollers), fixing unit 34, ejection roller unit 35, and ejection cassette 36.

Paper cassette 31 is a medium container to hold plural media 30. Note that transfer paper or colored paper is used as medium 30. The transfer paper is a medium for transfer to a shirt. For example, a toner fixed on the transfer paper is transferred to the shirt or the like by heat of an iron or the like. The colored paper is other-than-white-colored paper, and black-, blue- or red-colored paper, for example, is used. Paper feed roller 32 takes sheets of paper as media 30, one by one, out of paper cassette 31. Conveyance roller unit 33 feeds medium 30 fed from paper feed roller 32 to transfer belt 20. Drive rollers 21A, 21B drive transfer belt 20 to convey medium 30 carried on transfer belt 20. Transfer roller 22 transfers a toner image (or a developer image) formed by image formation unit 10 to medium 30 conveyed to transfer roller 22. Fixing unit 34 fixes the toner to medium 30. For example, fixing unit 34 internally has a heating element such as a halogen lamp, and includes heating roller 34*a* to heat a printing medium, and press roller 34*b* to press medium 30 toward heating roller 34*a*. Ejection roller unit 35 ejects medium 30, having the toner fixed thereto by fixing unit 34 from image formation apparatus 100, to the outside. Ejection cassette 36 stores medium 30 ejected by ejection roller unit 35.

Figure 2:
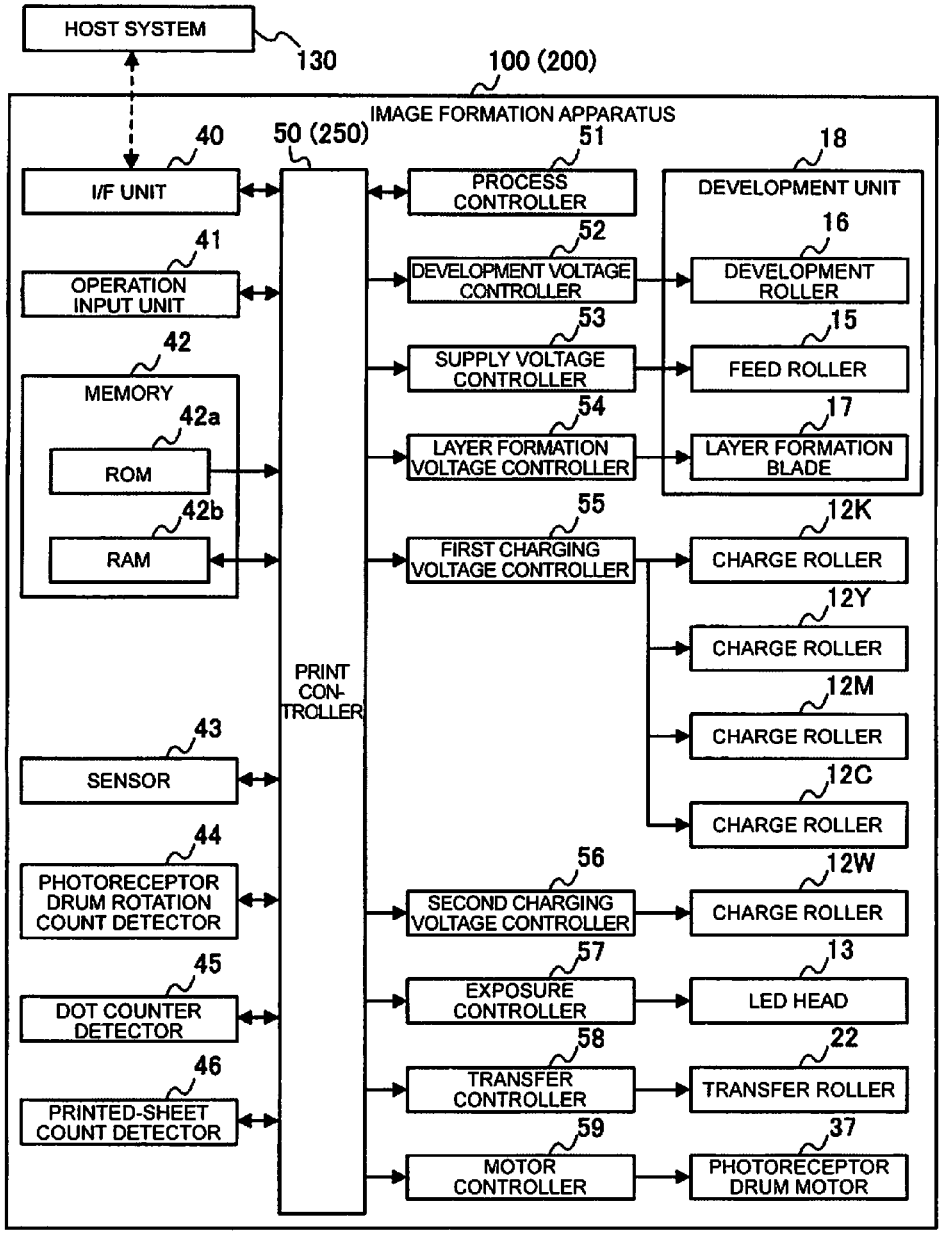
FIG. 2 is a block diagram illustrating in schematic form a configuration of a control system in the image formation apparatus according to Embodiments 1 and 2.

FIG. 2 is a block diagram illustrating in schematic form a configuration of a control system in image formation apparatus 100. Image formation apparatus 100 includes interface unit (hereinafter called I/F unit) 40, operation input unit 41, memory 42, sensor 43, photoreceptor drum rotation count detector 44, dot counter detector 45, printed-sheet count detector 46, print controller 50, process controller 51, development voltage controller 52, supply voltage controller 53, layer formation voltage controller 54, first charging voltage controller 55, second charging voltage controller 56, exposure controller 57, transfer controller 58, and motor controller 59. Incidentally, parenthesized reference numerals in FIG. 2 indicate a configuration in Embodiment 2.

I/F unit 40 is an interface with host system 130. For example, I/F unit 40 receives print data from host system 130. Operation input unit 41 accepts an operation input. Memory 42 is a storage unit configured to store various types of information. For example, memory 42 includes ROM (read only memory) 42*a*, and RAM (random access memory) 42*b*. For example, ROM 42*a* stores a flow of printing operation (or image forming operation), and equations of calculations used to perform various corrections. RAM 42*b* temporarily stores various data. Sensor 43 is a detector to detect a conveyance position of medium 30, temperature, humidity, or the like. Information detected by sensor 43 is provided to print controller 50. Photoreceptor drum rotation count detector 44 is an image carrier rotation count detector to detect the number of rotations of photoreceptor drum 11. For example, photoreceptor drum rotation count detector 44 detects the number of rotations of photoreceptor drum 11 for each job. The number of rotations detected by photoreceptor drum rotation count detector 44 is provided to print controller 50. Dot counter detector 45 counts the number of dots printed (or image-formed) by image formation unit 10. For example, dot counter detector 45 counts the number of dots printed by image formation unit 10 for each job. The number of dots counted by dot counter detector 45 is provided to print controller 50. Printed-sheet count detector 46 is a transferred-media count detector to count the number of printed sheets as the number of media 30 subjected to image formation by image formation unit 10. For example, printed-sheet count detector 46 counts the number of sheets printed by image formation unit 10 for each job. The number of printed sheets counted by printed-sheet count detector 46 is provided to print controller 50.

Print controller 50 is an image formation controller to control the whole of the processing to be performed by image formation apparatus 100. For example, print controller 50 determines the amount of correction of a charging voltage to be applied to charge roller 12 (i.e. the amount of charging voltage correction) according to the amount of usage of photoreceptor drum 11. Specifically, a larger amount of usage of photoreceptor drum 11 leads to a larger amount of charging voltage correction to be applied to charge roller 12. This is due to the fact that, as the amount of usage of photoreceptor drum 11 becomes larger, the surface of photoreceptor drum 11 is scraped in larger amounts and the remaining life of photoreceptor drum 11 becomes shorter. The shorter remaining life of photoreceptor drum 11 needs a smaller absolute value of the charging voltage to charge photoreceptor drum 11 with a constant voltage. Here, when a predetermined developer (or a second developer) is used as the developer to be fed from development roller 16, the surface of photoreceptor drum 11 is scraped in larger amounts, as compared to when another developer (or a first developer) is used. Also, print controller 50 determines that, as the number of rotations of photoreceptor drum 11 detected by photoreceptor drum rotation count detector 44 becomes larger, the amount of usage of photoreceptor drum 11 becomes larger and the degree of scraping of the film of photoreceptor drum 11 also becomes greater. Thus, the amount of remaining film of photoreceptor drum 11 becomes small, and the remaining life of photoreceptor drum 11 becomes short. Further, print controller 50 calculates an average image formation area that indicates a ratio of the number of exposed dots to the number of exposable dots, by using the number of sheets detected by printed-sheet count detector 46 and the number of dots detected by dot counter detector 45. Then, as the calculated average image formation area becomes smaller, the degree of scraping of the film of photoreceptor drum 11 becomes greater, and thus, the amount of remaining film of photoreceptor drum 11 becomes smaller. Thus, print controller 50 sets the amount of charging voltage correction to be applied to charge roller 12 larger, as the calculated average image formation area becomes smaller. This is due to the fact that, as the calculated average image formation area becomes smaller, the surface of photoreceptor drum 11 is scraped in larger amounts and the remaining life of photoreceptor drum 11 becomes shorter.

Process controller 51 performs voltage control on each roller. Development voltage controller 52 controls a voltage to be supplied to development roller 16. Supply voltage controller 53 controls a voltage to be supplied to feed roller 15. Layer formation voltage controller 54 controls a voltage to be supplied to layer formation blade 17. First charging voltage controller 55 controls voltages to be supplied to charge rollers 12K, 12Y, 12M, 12C for black, yellow, magenta, and cyan, respectively. Second charging voltage controller 56 controls a voltage to be supplied to charge roller 12W for white. Exposure controller 57 controls LED head 13. Transfer controller 58 controls transfer roller 22. Motor controller 59 controls photoreceptor drum motor 37. Photoreceptor drum motor 37 rotatably drives photoreceptor drum 11 in the direction of arrow d of FIG. 1. Also, photoreceptor drum 11, feed roller 15 and development roller 16 are provided with gears (not illustrated), which are formed in their end portions, respectively. Feed roller 15 and development roller 16 are rotatably driven by their respective gears meshing with the gear of photoreceptor drum 11. Incidentally, feed roller 15, development roller 16 and layer formation blade 17 form development unit 18.

Print controller 50, process controller 51, development voltage controller 52, supply voltage controller 53, layer formation voltage controller 54, first charging voltage controller 55, second charging voltage controller 56, exposure controller 57, transfer controller 58 and motor controller 59 can be implemented for example by a CPU (central processing unit) (not illustrated) executing a program stored in memory 42. Also, for example, these may be implemented in hardware by integrated logic IC such as an ASIC (Application Specific Integrated Circuits) or FPGA (Field Programmable Gate Array), or may be implemented in software by a DSP (Digital Signal Processor) or the like. Incidentally, print controller 50, process controller 51, development voltage controller 52, supply voltage controller 53, layer formation voltage controller 54, first charging voltage controller 55, second charging voltage controller 56, exposure controller 57, transfer controller 58 and motor controller 59 are also called a controller.

(Description of Operation)

In image formation apparatus 100 according to Embodiment 1 configured as described above, image formation units 10K, 10Y, 10M, 10C for black, yellow, magenta, and cyan, respectively, are different in operation from image formation unit 10W for white. Image formation units 10K, 10Y, 10M, 10C for black, yellow, magenta, and cyan, respectively, perform basically the same operation, and thus, operation of image formation apparatus 100 is described below by using image formation unit 10K for black and image formation unit 10W for white.

Operation input unit 41 accepts a power-on operation input from a user thereby to power on image formation apparatus 100. Host system 130 accepts an operation input from the user and transmits print data to image formation apparatus 100. In image formation apparatus 100, when I/F unit 40 receives the print data from host system 130, print controller 50 starts a printing operation.

In response to a command from print controller 50, motor controller 59 controls photoreceptor drum motor 37 to rotate photoreceptor drums 11K, 11W in the direction of arrow d (see FIG. 1). Feed rollers 15K, 15W and development rollers 16K, 16W connected via the gears to photoreceptor drums 11K, 11W, respectively, are also simultaneously rotated.

When photoreceptor drums 11K, 11W rotate, charge rollers 12K, 12W also rotate along with photoreceptor drums 11K, 11W, and charge the surfaces of photoreceptor drums 11K, 11W, respectively. When the surfaces of photoreceptor drums 11K, 11W are charged, LED heads 13K, 13W form electrostatic latent images on the charged surfaces of photoreceptor drums 11K, 11W, respectively, based on the print data. When the electrostatic latent images are formed on the surfaces of photoreceptor drums 11K, 11W, the toner held by feed rollers 15K, 15W is fed to the surfaces of development rollers 16K, 16W, respectively. The layer thicknesses of the toner on the surfaces of development rollers 16K, 16W are made uniform by being restricted by layer formation blades 17K, 17W, respectively. When the surfaces of development rollers 16K, 16W having uniform toner layers come into contact with the surfaces of photoreceptor drums 11K, 11W, respectively, the toner adheres to the electrostatic latent images on photoreceptor drums 11K, 11W.

The rotation of drive rollers 21A, 21B allows also for rotation of transfer belt 20. Medium 30 is fed by paper feed roller 32 and is then conveyed onto transfer belt 20 by conveyance roller unit 33. Then, medium 30 is conveyed by transfer belt 20.

Also in image formation units 10Y, 10M, 10C for yellow, magenta and cyan, toner images are formed on photoreceptor drums 11Y, 11M, 11C in the same manner. The toner images on the surfaces of photoreceptor drums 11K, 11Y, 11M, 11C, 11W are transferred in sequence to medium 30 by transfer rollers 22K, 22Y, 22M, 22C, 22W, respectively, subjected to a high voltage applied by transfer controller 58.

When medium 30 having the toner images transferred thereto is conveyed to fixing unit 34, medium 30 is pressed toward preheated heating roller 34*a* by press roller 34*b*. Thereby, the toner images on medium 30 are fixed to medium 30 by application of heat and pressure. Medium 30 which has undergone a fixing process is ejected to ejection cassette 36 by ejection roller unit 35. After going through the above, the printing operation comes to an end.

In Embodiment 1, the charging voltage of charge roller 12 is changed according to the amount of the remaining film of photoreceptor drum 11. For example, print controller 50 determines the amount of the remaining film of photoreceptor drum 11 from the number of rotations and the print area of photoreceptor drum 11, thereby to correct the charging voltage of charge roller 12.

Figure 3:
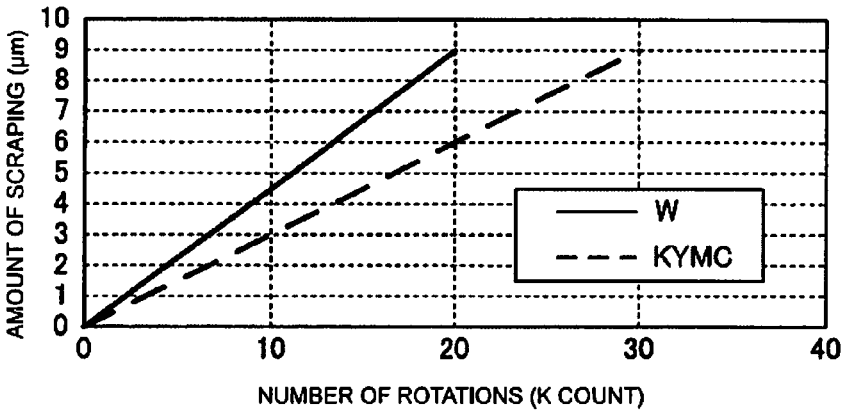
FIG. 3 is a schematic graphical representation illustrating a relationship between the number of rotations of a photoreceptor drum and the amount of scraping of a photoreceptor film, which is observed when printing is performed with an average print area set at 5%, in Embodiment 1.

FIG. 3 is a schematic graphical representation illustrating a relationship between the number of rotations of photoreceptor drum 11 and the amount of scraping of a photoreceptor film (or a photoreceptor film portion), which is observed when printing is performed with an average print area set at 5%. Note that the average print area is a value obtained by dividing the total number of exposed dots by the total number of exposable dots. As illustrated in FIG. 3, photoreceptor drum 11W for white is scraped by 9 μm at the count of 20,000, and photoreceptor drums 11K, 11Y, 11M, 11C for black, yellow, magenta and cyan are scraped by 9

μm at the count of 30,000. This indicates that the amount of scraping of the surface of photoreceptor drum 11 varies according to a difference in the hardness of the toner according to whether organic pigment or metallic pigment, for example, is used, based on properties of the pigment for use in the toner. In other words, this indicates that, when the second developer (here, the white toner) which is harder and more prone to scrape photoreceptor drum 11 than the first developer (here, the black, yellow, magenta and cyan toner) is used, the amount of remaining film of photoreceptor drum 11 is different even with the same amount of usage of photoreceptor drum 11.

Figure 4:
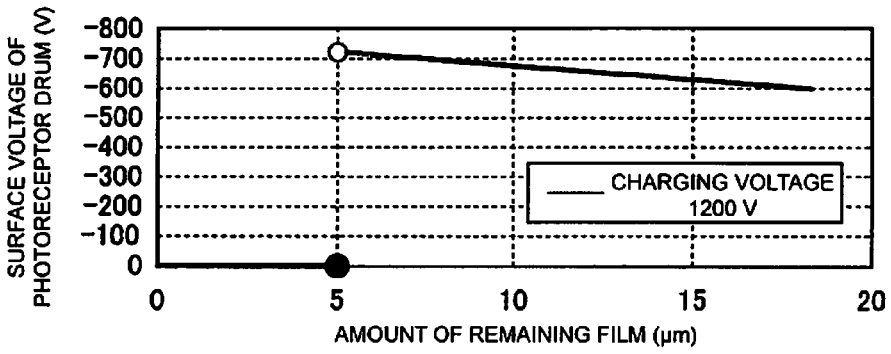
FIG. 4 is a schematic graphical representation illustrating a relationship between the amount of remaining film of the photoreceptor drum and surface voltage of the photoreceptor drum in Embodiment 1.

FIG. 4 is a schematic graphical representation illustrating a relationship between the amount of remaining film of photoreceptor drum 11 and the surface voltage of the photoreceptor drum. When the charging voltage of charge roller is set to −1200 V, the amount of remaining film of photoreceptor drum 11 is 18 μm and the surface voltage of the photoreceptor drum is −600 V. Then, when the amount of remaining film decreases to 9 μm, the surface potential of photoreceptor drum 11 is −690 V. FIG. 4 indicates that the scraping of the film of photoreceptor drum 11 causes a change in the surface potential of photoreceptor drum 11. Also, FIG. 4 indicates that, when the amount of the remaining film becomes equal to or less than 5 μm, the voltage of photoreceptor drum 11 becomes 0 V to thus render it impossible to hold electric charge. It is known that a change in the surface voltage of photoreceptor drum 11 produces a difference in halftone gray level, in particular. Thus, it is necessary to adjust the charging voltage of charge roller 12 according to the amount of remaining film of photoreceptor drum 11. Also, when the amount of remaining film of photoreceptor drum 11 becomes equal to or less than 5 μm, the electric charge cannot be held, and thus, it is necessary to leave the film of photoreceptor drum 11 to some extent. In Embodiment 1, the amount of remaining film at which the life of photoreceptor drum 11 ends is set equal to or more than 9 μm.

With reference to FIG. 3, a correction factor for the charging voltage is determined according to attributes of the toner. For the white toner, correction factor aw (or a first correction factor) is represented as Equation (2). For the black, yellow, cyan or magenta toner, correction factor ac (or a second correction factor) is represented as Equation (3).

$$aw=0.45 \tag{2}$$

$$ac=0.3 \tag{3}$$

Note that the correction factors are each obtained by calculating a gradient of FIG. 3. In other words, the correction factors indicate the amount of scraping of photoreceptor drum 11 with respect to the number of rotations of photoreceptor drum 11. The correction factors indicate that a larger number of rotations of photoreceptor drum 11 leads to a larger amount of scraping of photoreceptor drum 11. Also, the toner of a specific color (here, the white toner) involves a larger amount of scraping of photoreceptor drum 11 with respect to the number of rotations of photoreceptor drum 11 than the toner of another color (here, the black, yellow, magenta or cyan toner). Thus, the toner of the specific color involves the shorter remaining life of photoreceptor drum 11 with respect to the number of rotations of photoreceptor drum 11 than the toner of the other colors.

Figure 5:
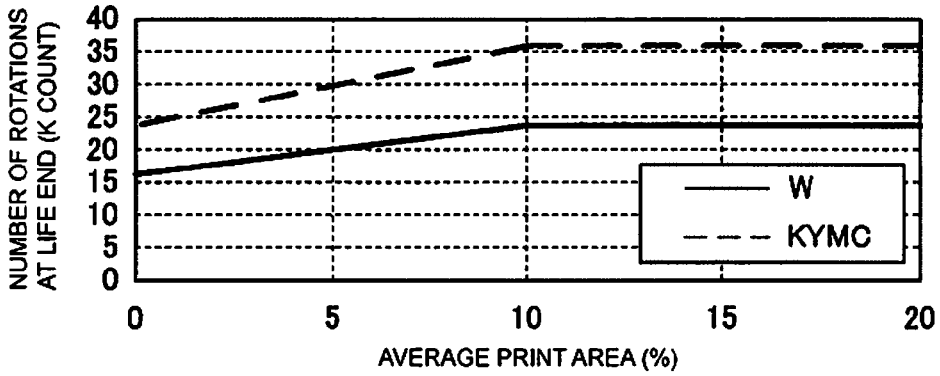
FIG. 5 is a schematic graphical representation illustrating a relationship between the average print area and the number of rotations at life's end in Embodiment 1.

FIG. 5 is a schematic graphical representation illustrating a relationship between the average print area and the number of rotations at the life's end. The number of rotations at the life's end refers to how many rotations photoreceptor drum 11 has made until the amount of remaining film becomes equal to 9 μm. In the case of the white toner, the average print area is changed from 5% to 0% thereby to reduce the number of rotations at the life's end from a count of 20,000 to a count of 6,000. On the other hand, the average print area is changed to 10%, thereby to increase the number of rotations at the life's end to a count of 24,000. Also in the case of the black, yellow, magenta or cyan toner, the average print area is changed from 5% to 0% thereby to reduce the number of rotations at the life's end from a count of 30,000 to a count of 24,000. On the other hand, the average print area is changed to 10%, thereby to increase the number of rotations at the life's end to a count of 36,000. This is due to the fact that the amount of toner on development roller 16 varies according to the average print area. When the average print area is in the neighborhood of 0%, the toner is not used, thus increasing the amount of toner on development roller 16 and hence increasing the likelihood of a scraping of photoreceptor drum 11. In short, a smaller average print area leads to a larger amount of scraping of the surface of photoreceptor drum 11. Thus, the smaller average print area leads to the shorter remaining life of photoreceptor drum 11.

FIG. 5 indicates that the amount of scraping of photoreceptor drum 11 varies according to the average print area. Thus, it is necessary to correct the above-mentioned correction factors according to the average print area. For example, referring to FIG. 5, for the white toner, when the average print area is 10%, it is necessary to correct the above-mentioned first correction factor so that the amount of scraping of photoreceptor drum 11 is 9 μm at the count of 24,000. Also, when the average print area is 0%, it is necessary to correct the above-mentioned first correction factor so that the amount of scraping of photoreceptor drum 11 is 9 μm at the count of 16,000. Meanwhile, for the black, yellow, magenta or cyan toner, when the average print area is 10%, it is necessary to correct the above-mentioned second correction factor so that the amount of scraping of photoreceptor drum 11 is 9 μm at the count of 36,000. Also, when the average print area is 0%, it is necessary to correct the above-mentioned second correction factor so that the amount of scraping of photoreceptor drum 11 is 9 μm at the count of 24,000.

A correctional equation for correcting the correction factors, calculated based on the above discussion, is represented as Equation (4).

$$b=-0.04\times m+1.21 \tag{4}$$

The above-mentioned correction factors are multiplied by correction value b calculated by the correctional equation. Note that, when the average print area is equal to or more than 10%, m is set equal to 10 (m=10) for the calculation of Equation (4). According to the correctional equation, therefore, a larger average print area leads to smaller correction factors and hence to a smaller amount of scraping of photoreceptor drum 11.

An equation for determination of the amount of remaining film of the photoreceptor drum from the above-mentioned correction factors and correctional equation is represented as Equation (5) for the white toner, or is represented as Equation (6) for the black, yellow, magenta or cyan toner. Note that an initial value of the amount of remaining film of photoreceptor drum 11 is set to 18 μm.

$$Lw=18-aw\times n\times b \tag{5}$$

$$Lc=18-ac\times n\times b \tag{6}$$

Here, n denotes a value (or k count) obtained by dividing the number of rotations of photoreceptor drum 11 by 1000.

Figure 6:
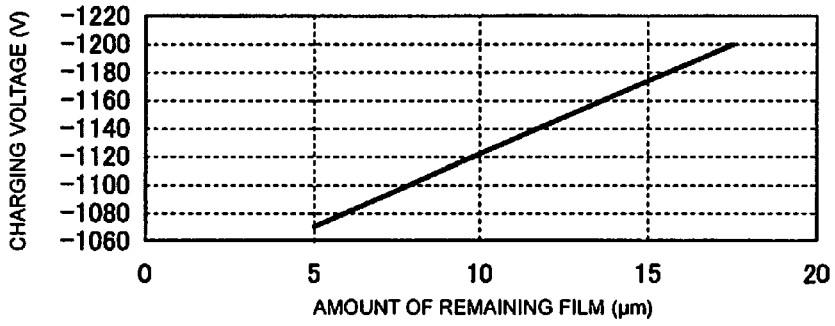
FIG. 6 is a schematic graphical representation illustrating a relationship between the amount of remaining film of the photoreceptor drum and the charging voltage required to charge the photoreceptor drum with −600 V in Embodiment 1.

FIG. 6 is a schematic graphical representation illustrating a relationship between the amount of remaining film of photoreceptor drum 11 and the charging voltage required to charge photoreceptor drum 11 with −600 V. As illustrated in FIG. 6, the necessary charging voltage NV is represented as Equation (7):

$$NV=(-10\times L)-1020 \quad (7)$$

where L denotes the amount of remaining film.

According to Equation (7), a smaller amount of remaining film, or equivalently, a larger amount of scraping of the film on the surface of photoreceptor drum 11, leads to a larger amount of correction of the charging voltage and hence to a smaller absolute value of the necessary charging voltage NV. Here, (−10×L) in Equation (7) indicates the amount of correction of the charging voltage. Then, the amount L of remaining film becomes smaller as the number of rotations of photoreceptor drum 11 becomes larger or the average print area becomes smaller. Further, the toner of a specific color (here, the white toner) involves a larger amount of scraping of photoreceptor drum 11 with respect to the number of rotations of photoreceptor drum 11 and the average print area than does the toner of another color (here, the black, yellow, magenta or cyan toner). Thus, the toner of the specific color involves the shorter remaining life of photoreceptor drum 11 with respect to the number of rotations of photoreceptor drum 11 and the average print area than does the toner of other colors. Performing the calculations as described above enables keeping the charging voltage of photoreceptor drum 11 constant regardless of a difference in the amount of film reduction due to a difference in the attribute of the toner.

Note that, even when photoreceptor drum 11 is rotated without any toner image formation, such as during a warm-up, the amount of remaining film may be calculated to adjust the necessary charging voltage NV. In such a case, the value of m can be set equal to 0. Also, the number of rotations of photoreceptor drum 11 during a warm-up, or when otherwise rotated, can be used as the value of n.

For example, print controller 50 causes memory 42 to store a cumulative value of the number of printed dots (or the cumulative number of dots) and a cumulative value of the number of printed sheets (or the cumulative number of printed sheets), based on the above discussion. It is assumed here that the cumulative number of dots and the cumulative number of printed sheets are stored for each color. Then, for each job, print controller 50 adds the number of dots for each color detected by dot counter detector 45 to the cumulative number of dots for each color thereby to calculate the total number of dots for each color, and also adds the number of printed sheets for each color detected by printed-sheet count detector 46 to the cumulative number of printed sheets for each color thereby to calculate the total number of printed sheets for each color. Print controller 50 divides the calculated total number of dots for each color by the number of printable dots per medium of a predetermined size, for example, per sheet of A4-size paper, and further divides a divided result by the calculated total number of printed sheets for each color thereby to calculate the average print area for each color. Print controller 50 uses the thus calculated average print area for each color to calculate the correction value b for each color by the above-mentioned correctional equation represented as Equation (4). Note that the cumulative number of printed sheets and the cumulative number of dots are set to their respective initial values (for example, 0) at the start time of use of image formation apparatus 100 and at the time of replacement of photoreceptor drum 11. Also, print controller 50 causes memory 42 to store the total number of dots and the total number of printed sheets thus calculated, as the cumulative number of dots and the cumulative number of printed sheets, respectively.

Also, print controller 50 causes memory 42 to store a cumulative value of the number of rotations of photoreceptor drum 11 (or a cumulative count value) for each color. Then, for each job, print controller 50 adds the number of rotations for each color detected by photoreceptor drum rotation count detector 44 to the cumulative count value for each color thereby to calculate the total number of rotations for each color. Print controller 50 uses, as n, the thus calculated total number of rotations for each color to calculate the amount of remaining film for each color by using the above Equation (5) for white or by using the above Equation (6) for other colors. Note that the correction value for each color calculated in a manner as above described is used as the value of b. Also, print controller 50 causes memory 42 to store the thus calculated total number of rotations as the cumulative number of rotations.

Print controller 50 uses the amount of remaining film, for each color calculated in a manner as above described to calculate the necessary charging voltage NV for each color by the above Equation (7). Print controller 50 commands first charging voltage controller 55 and second charging voltage controller 56 to apply necessary charging voltage NV for each color calculated in a manner as above described to charge roller 12 for each color. Upon receipt of such a command, first charging voltage controller 55 and second charging voltage controller 56 apply the necessary charging voltages to charge rollers 12 for the colors, respectively.

According to Embodiment 1, as described above, detection of the print area and the number of rotations of photoreceptor drum 11 enables keeping the surface potential of photoreceptor drum 11 constant even without the provision of another substrate or the like for current detection. Thus, a high-quality image can be obtained with stability.

Figure 7:
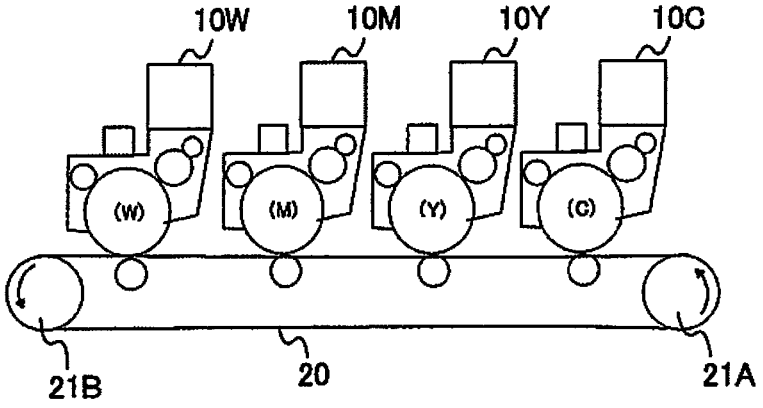
FIG. 7 is a schematic diagram illustrating an arrangement of the image formation units in a modification of Embodiment 1.

In Embodiment 1, as illustrated in FIG. 1, image formation units 10 for five colors are used; however, the invention is not so limited. As illustrated for example in FIG. 7, image formation units 10C, 10Y, 10M, 10W for four colors, i.e. cyan, yellow, magenta and white, may be used. Further, image formation units 10 for more or fewer colors may be used.

Embodiment 2

Figure 8:
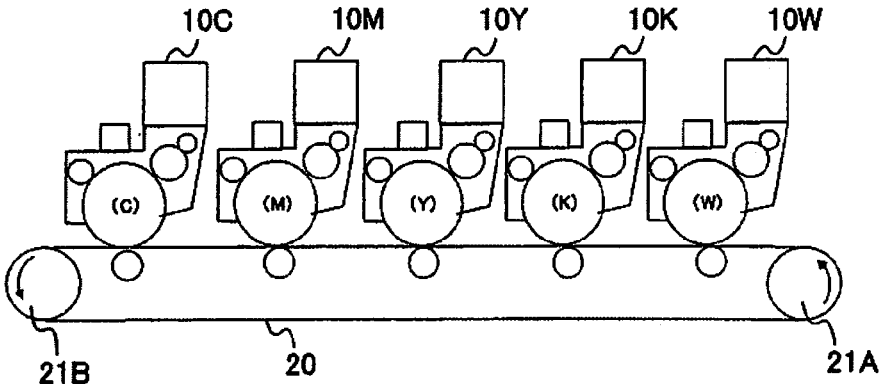
FIG. 8 is a schematic diagram illustrating the arrangement of the image formation units in the image formation apparatus according to Embodiment 2.

Although an overall configuration of image formation apparatus 200 according to Embodiment 2 is substantially the same as that of image formation apparatus 100 according to Embodiment 1 illustrated in FIG. 1, image formation apparatus 200 is different from image formation apparatus 100 in the arrangement of image formation units 10. FIG. 8 is a schematic diagram illustrating the arrangement of image formation units 10 in image formation apparatus 200 according to Embodiment 2. As illustrated in FIG. 8, in image formation apparatus 200 according to Embodiment 2, image formation unit 10W for white is arranged most upstream of the conveyance path of medium 30, and thereafter, image formation units 10K, 10Y, 10M, 10C for black, yellow, magenta and cyan are arranged in sequence.

As illustrated in FIG. 2, image formation apparatus 200 according to Embodiment 2 includes I/F unit 40, operation input unit 41, memory 42, sensor 43, photoreceptor drum rotation count detector 44, dot counter detector 45, printed-sheet count detector 46, print controller 250, process controller 51, development voltage controller 52, supply voltage controller 53, layer formation voltage controller 54, first charging voltage controller 55, second charging voltage controller 56, exposure controller 57, transfer controller 58, and motor controller 59. Image formation apparatus 200 according to Embodiment 2 is different from image formation apparatus 100 according to Embodiment 1 in the processing performed by print controller 250.

Besides performing the same processing as that in Embodiment 1, print controller 250 determines that the remaining longevities of photoreceptor drums 11K, 11Y, 11M, 11C for the other colors arranged rearward of photoreceptor drum 11W for white are shorter than those when arranged forward of photoreceptor drum 11W for white.

Figure 9:
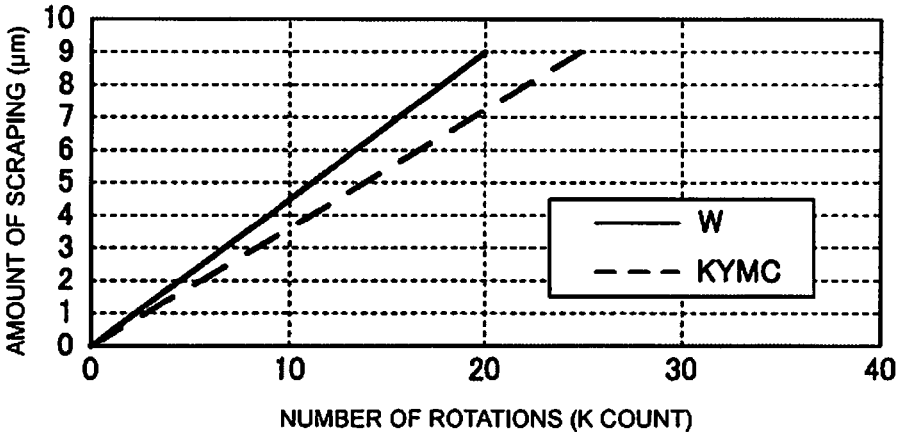
FIG. 9 is a schematic graphical representation illustrating a relationship between the number of rotations of the photoreceptor drum and the amount of scraping of the photoreceptor film, which is observed when printing is performed with the average print area set at 5%, in Embodiment 2.

FIG. 9 is a schematic graphical representation illustrating a relationship between the number of rotations of photoreceptor drum 11 and the amount of scraping of the photoreceptor film, which is observed when printing is performed with the average print area set at 5%, in Embodiment 2. As illustrated in FIG. 9, photoreceptor drum 11W for white is scraped by 9 μm at the count of 20,000, and photoreceptor drums 11K, 11Y, 11M, 11C for black, yellow, magenta and cyan are scraped by 9 μm at the count of 25,000. Thus, in Embodiment 2, the amount of film scraping of photoreceptor drums 11K, 11Y, 11M, 11C for black, yellow, magenta and cyan is larger as compared to that in Embodiment 1. This may be due to the fact that image formation unit 10W for white is located on the upstream side, and thus, a reverse transfer occurs in image formation units 10K, 10Y, 10M, 10C located on the downstream side, so that the white toner adheres to photoreceptor drums 11K, 11Y, 11M, 11C.

Correction factor dac (or a third correction factor) for the charging voltage in image formation unit 10 located downstream of that for white, as determined with reference to FIG. 9, is represented as Equation (8).

$$dac=0.36 \tag{8}$$

Note that the correction factor is obtained by calculating a gradient of FIG. 9.

Besides performing the same processing as that in Embodiment 1, print controller 250 in Embodiment 2 performs a calculation by using the above Equation (8) for the charging voltage in image formation unit 10 located downstream of that for white. Thus, print controller 250 can determine that the amount of scraping of the surface of photoreceptor drum 11 arranged rearward of that for a predetermined color (here, white) is larger than the amount of scraping of the surface of photoreceptor drum 11 arranged forward of that for the predetermined color, based on the number of rotations detected by photoreceptor drum rotation count detector 44. In other words, print controller 250 can determine that the remaining life of photoreceptor drum 11 arranged rearward of that for the predetermined color is shorter than the remaining life of photoreceptor drum 11 arranged forward of that for the predetermined color, based on the number of rotations detected by photoreceptor drum rotation count detector 44. Further, print controller 250 can determine that the amount of scraping of the surface of photoreceptor drum 11 arranged rearward of that for a predetermined color (here, white) is larger than the amount of scraping of the surface of photoreceptor drum 11 arranged forward of that for the predetermined color, based on the calculated average print area. In other words, print controller 250 can determine that the remaining life of photoreceptor drum 11 arranged rearward of that for the predetermined color is shorter than the remaining life of photoreceptor drum 11 arranged forward of that for the predetermined color, based on the calculated average print area.

According to Embodiment 2, as described above, the charging voltage in image formation unit 10 on the downstream side is corrected based on the installed position of image formation unit 10W for white, thereby to enable keeping the charging voltage constant and thus enable achieving a stable image quality.

Figure 10:
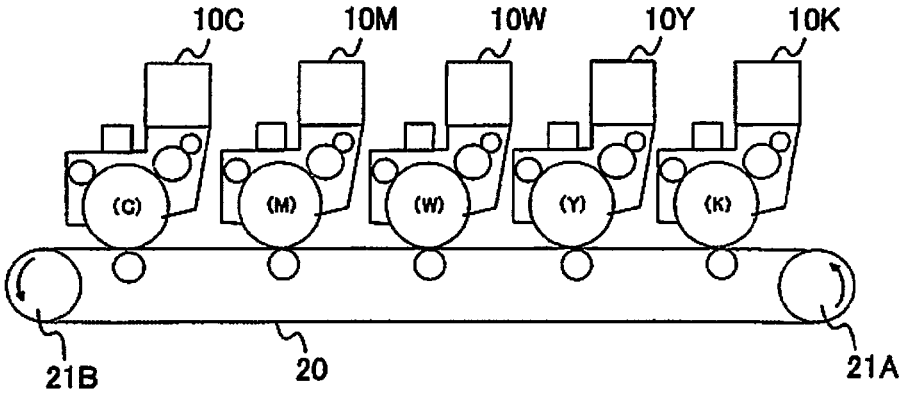
FIG. 10 is a schematic diagram illustrating the arrangement of the image formation units in a modification of Embodiment 2.

In Embodiment 2, image formation unit 10W for white is arranged most upstream; however, the invention is not so limited. As illustrated for example in FIG. 10, image formation unit 10W for white may be arranged between other image formation units 10 (e.g. between image formation unit 10Y for yellow and image formation unit 10M for magenta, as illustrated in FIG. 10). In the case as illustrated in FIG. 10, second correction factor ac is used for the charging voltage of image formation units 10K, 10Y arranged upstream of image formation unit 10W for white, and third correction factor dac is used for the charging voltage of image formation units 10M, 10C arranged downstream of image formation unit 10W for white.

In Embodiments 1 and 2 described above, print controllers 50, 250 calculate the amount of remaining film of photoreceptor drum 11 by using the total number of dots, the total number of printed sheets and the total number of rotations since a predetermined time, for example, since the start time of use of the image formation apparatus and the time of replacement of photoreceptor drum 11; however, the invention is not so limited. For example, print controllers 50, 250 cause memory 42 to store a cumulative value of the amount of scraping (or the cumulative amount of scraping). Print controllers 50, 250 obtain the number of dots and the number of printed sheets for each job from dot counter detector 45 and printed-sheet count detector 46, respectively, and calculate, for each job, the average print area indicating the ratio of the number of exposed dots to the number of exposable dots, and also calculate correction value b by using the calculated value of the average print area. Also, print controllers 50, 250 obtain the number of rotations of the photoreceptor drum for each job from photoreceptor drum rotation count detector 44, and calculate the amount of scraping for each job by using calculated correction value b and Equations (2), (3), (5), (6) and (8). Then, print controllers 50, 250 calculate the total amount of scraping by adding the amount of scraping for each job to the cumulative amount of scraping, and calculate the amount of remaining film by subtracting the total amount of scraping from the initial value (for example, 18 μm) of the amount of remaining film. Thereby, the amount of remaining film may be calculated. Also, print controllers 50, 250 may calculate the amount of remaining film in a manner as given below; specifically, print controllers 50, 250 cause memory 42 to store a cumulative value of the amount of remaining film (or the cumulative amount of remaining film), and subtract the amount of scraping for each job, calculated in the manner as above mentioned, from the cumulative amount of remaining film, thereby to calculate the amount of remaining film.

In Embodiments 1 and 2 described above, the description is given with regard to an example in which the invention is applied to a tandem type image formation apparatus; however, the invention may also be applied to an image formation apparatus of a four-cycle type having a single image carrier, or of an intermediate transfer belt type. Also, in Embodiments 1 and 2 described above, the description is given with regard to the developer in which titanium oxide as the metal-base colorant is used as the colorant; however, such a developer is not limited to being used for the white toner, and a developer in which iron oxide as the metallic pigment is used as the colorant for the black toner, or a developer in which fine metallic flakes as the metal-base colorant are used as a colorant for the metallic color toner (for example, a gold color and a silver color) may be used. Further, in Embodiments 1 and 2 described above, the description is given with regard to an example in which the invention is applied to a printer; however, the invention may also be applied to image formation apparatuses such as MFP (Multifunction Printer), a facsimile device and a copying machine.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a first image formation unit including a first image carrier and a first charging member configured to charge the first image carrier, the first image formation unit configured to use a first developer;

a second image formation unit including a second image carrier and a second charging member configured to charge the second image carrier, the second image formation unit configured to use a second developer; and a controller configured to determine a first amount of charging voltage correction for correcting a first charging voltage to be applied to the first charging member according to a first number of rotations of the first image carrier and a first average image formation area of the first image carrier, and to determine a second amount of charging voltage correction for correcting a second charging voltage to be applied to the second charging member according to a second number of rotations of the second image carrier and a second average image formation area of the second image carrier;

wherein, in a condition in which the first average image formation area and the second average image formation area are equal and the first number of rotations of the first image carrier and the second number of rotations of the second image carrier are equal, the second amount of charging voltage correction is larger than the first amount of charging voltage correction.

2. The image formation apparatus according to claim 1, further comprising:

a first exposure unit configured to perform an exposure on a corresponding dot and thereby form an electrostatic latent image on the first image carrier;

a second exposure unit configured to perform an exposure on a corresponding dot and thereby form an electrostatic latent image on the second image carrier;

a transferred-media count detector configured to detect the number of media to which the developer has been transferred by the first image formation unit and the second image formation unit; and a dot counter detector configured to detect a first number of dots subjected to the exposure by the first exposure unit and a second number of dots subjected to the exposure by the second exposure unit, wherein the controller calculates a ratio of the first number of exposed dots to the number of exposable dots by using the number of media detected by the transferred-media count detector and the first number of dots detected by the dot counter detector, calculates a ratio of the second number of exposed dots to the number of exposable dots by using the number of media detected by the transferred-media count detector and the second number of dots detected by the dot counter detector, corrects the first amount of charging voltage correction based on the ratio of the first number of exposed dots to the number of exposable dots, and corrects the second amount of charging voltage correction based on the ratio of the second number of exposed dots to the number of exposable dots.

3. The image formation apparatus according to claim 1, wherein the controller calculates an amount of remaining film of the first image carrier based on the first number of rotations of the first image carrier and the first average image formation area, calculates the first amount of charging voltage correction based on the amount of remaining film of the first image carrier, calculates an amount of remaining film of the second image carrier based on the second number of rotations of the second image carrier and the second average image formation area, calculates the second amount of charging voltage correction based on the amount of remaining film of the second image carrier.

4. The image formation apparatus according to claim 1, wherein a colorant of the first developer does not comprise a metal-base colorant, and a colorant of the second developer comprises a metal-base colorant.

5. The image forming apparatus according to claim 4, wherein the metal-base colorant is titanium dioxide.

6. The image forming apparatus according to claim 5, wherein the second developer is a white toner.

7. The image forming apparatus according to claim 1, wherein the second developer is a white toner.

8. An image formation apparatus comprising:

a first image formation unit including a first image carrier and a first charging member configured to charge the first image carrier, the first image formation unit configured to use a first developer;

a second image formation unit including a second image carrier and a second charging member configured to charge the second image carrier, the second image formation unit configured to use a second developer;

a second exposure unit configured to perform an exposure on a corresponding dot and thereby form an electrostatic latent image on the second image carrier;

a transferred-media count detector configured to detect a number of media to which the developer has been transferred by the second image formation unit;

a dot counter detector configured to detect a second number of dots subjected to the exposure by the second exposure unit; and a controller configured to:

obtain a first number of rotations of the first image carrier;

obtain a second number of rotations of the second image carrier;

obtain a first average image formation area of the first image carrier;

obtain a second average image formation area of the second image carrier;

determine and set a first amount of charging voltage correction for correcting a charging voltage to be applied to the first charging member according to the obtained first number of rotations of the first image carrier and the obtained first average image formation area of the first image carrier; and determine and set a second amount of charging voltage correction for correcting a charging voltage to be applied to the second charging member according to the obtained second number of rotations of the second image carrier and the obtained second average image formation area to the second image carrier wherein the controller determines and sets the first amount of charging voltage correction larger as the obtained first average image formation area of the first image carrier becomes smaller and the obtained first number of rotations of the first image carrier becomes larger, the controller sets the second amount of charging voltage correction larger as the obtained second number of rotations of the second image carrier becomes larger, and the controller calculates a ratio of the second number of exposed dots to a number of exposable dots by using the number of media detected by the transferred-media count detector and the second number of dots detected by the dot counter detector, and sets the second amount of charging voltage correction larger as the calculated ratio becomes smaller.

* * * * *